US005404930A

United States Patent [19]

Stanton et al.

[11] Patent Number: 5,404,930

[45] Date of Patent: Apr. 11, 1995

[54] METHOD AND APPARATUS FOR CASTING AN AIRFOIL

[75] Inventors: Paul Stanton, North Canton; Louis H. Monte, Minerva, both of Ohio

[73] Assignee: PCC Airfoils, Inc., Cleveland, Ohio

[21] Appl. No.: 177,927

[22] Filed: Jan. 6, 1994

[51] Int. Cl.[6] ..... B22D 27/04; B22C 9/04; B22C 9/08

[52] U.S. Cl. ..... 164/122.1; 164/122.2; 164/134; 164/235; 164/361; 164/358

[58] Field of Search ..... 164/516, 122.1, 122.2, 164/134, 235, 361, 358, 45

[56] References Cited

U.S. PATENT DOCUMENTS

| | | | |
|---|---|---|---|
| 2,970,075 | 1/1961 | Grenoble . | |
| 3,485,291 | 12/1969 | Piearcey . | |
| 3,815,661 | 6/1974 | Carran et al. | 164/134 |
| 3,915,761 | 10/1975 | Tschinkel et al. . | |
| 4,353,405 | 10/1982 | Kolakowski et al. . | |
| 4,591,383 | 5/1986 | McGarry et al. | 75/93 R |
| 5,020,583 | 6/1991 | Aghajanian et al. . | |

*Primary Examiner*—Kuang Y. Lin
*Attorney, Agent, or Firm*—Tarolli, Sundheim & Covell

[57] ABSTRACT

An improved mold for use in casting a metal airfoil has an airfoil mold cavity and a starter chamber. A lower end of the starter chamber is formed by a chill plate. A filter is disposed in the starter chamber between the airfoil mold cavity and the chill plate. When an airfoil is to be cast, molten metal is conducted into the starter chamber, into passages in the filter and into the airfoil mold cavity. The molten metal is solidified upward in the starter chamber from the chill plate and through the passages in the filter. The filter blocks migration of impurities from the starter chamber to the airfoil mold cavity as the metal solidifies in the starter chamber. As the molten metal begins to solidify in the airfoil mold cavity, the molten metal is solidified as a large number of columnar grain crystals which extend from the passages in the filter into the airfoil mold cavity. If a single crystal airfoil is desired, a single crystal selector may be provided between the starter chamber and the airfoil mold cavity.

60 Claims, 4 Drawing Sheets

METHOD AND APPARATUS FOR CASTING AN AIRFOIL

BACKGROUND OF THE INVENTION

The present invention relates to an improved method and apparatus for use in casting an airfoil. The airfoil may have either a columnar grain or single crystal crystallographic structure.

A known apparatus for use in casting an airfoil with a columnar grain crystallographic structure is disclosed in U.S. Pat. No. 3,485,291. A known apparatus for casting an airfoil with a single crystal crystallographic structure is disclosed in U.S. Pat. No. 5,062,468. The airfoil molds disclosed in the aforementioned patents are of the top fill type. However, a mold of the bottom fill type is disclosed in U.S. Pat. No. 3,915,761.

During the casting of airfoils with the molds disclosed in the aforementioned patents, impurities tend to accumulate adjacent to a chill plate. As the molten metal in the mold solidifies, these impurities tend to migrate upward into the airfoil mold cavity. The upward migration of the impurities into the airfoil mold cavity may result in the formation of inclusions in the airfoil. Of course, the presence of inclusions is detrimental to the properties of the airfoil.

Airfoils having a columnar grain crystallographic structure have improved transverse properties if there are a relatively large number of columnar grains in the airfoil. Thus, if a portion of the airfoil is formed with a large number of columnar grains, the transverse properties of that portion of the airfoil are enhanced. Known airfoils having a fine columnar grain root portion may have as many as 100 columnar grains per square inch of cross sectional area.

SUMMARY OF THE INVENTION

The present invention provides a new and improved method and apparatus for casting an airfoil. The apparatus includes a mold having an airfoil mold cavity and a starter chamber. In accordance with a feature of the invention, a filter is provided in the starter chamber. The filter blocks migration of impurities from the starter chamber into the airfoil mold cavity. In addition, during the casting of columnar grain airfoils, the filter causes the molten metal in the starter chamber to solidify into the airfoil mold cavity as a relatively large number of columnar grains.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF SPECIFIC PREFERRED EMBODIMENTS OF THE INVENTION

General Description

Figure 1:
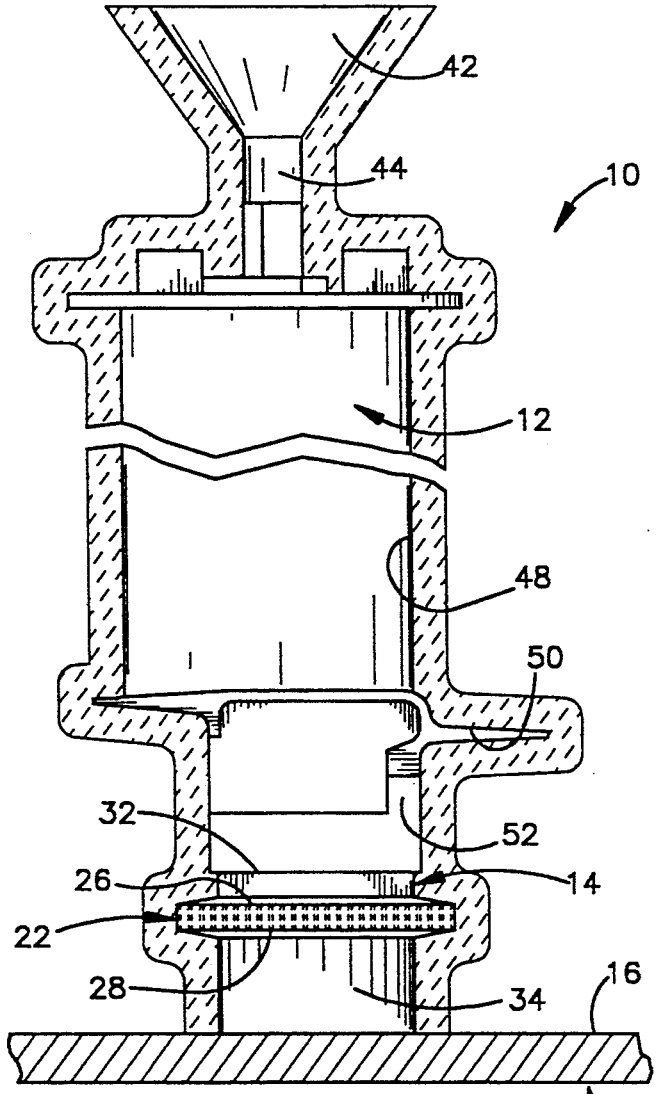
FIG. 1 is a schematic sectional view of a top fill mold constructed in accordance with the present invention and having a filter in a starter chamber.

An improved mold 10 is used to cast an improved airfoil having a columnar grain crystallographic structure. The mold 10 includes an airfoil mold cavity 12. The airfoil mold cavity 12 has a configuration corresponding to the desired configuration of the specific columnar grain airfoil to be cast in the mold.

The mold 10 also includes a starter chamber 14. The starter chamber 14 is connected in fluid communication with the lower end portion of the airfoil mold cavity 12. An upper side surface 16 of a chill plate 18 defines the lower end of the starter chamber 14. The mold 10 is supported on and makes a fluid tight seal with the horizontal upper side surface 16 of the chill plate 18.

In accordance with one of the features of the invention, a filter 22 is provided in the starter chamber 14. The filter 22 blocks migration of impurities into the airfoil mold cavity 12.

During use of the mold 10 to cast an airfoil, impurities tend to condense and otherwise accumulate adjacent to the relatively cold upper side surface 16 of the chill plate 18. The filter 22 blocks upward movement of these impurities into the airfoil mold cavity 12. This results in the cast airfoil being completely or almost completely free of inclusions. If an inclusion is formed in the cast airfoil, the inclusion is of relatively small size.

In addition, during the casting of an airfoil with a columnar grain crystallographic structure, the filter 22 causes the metal to solidify as a very large number of columnar grains. By having a large number of columnar grains solidify upwardly into the lower end portion of the airfoil mold cavity 12 from the starter chamber 14, the lower end portion of the airfoil has a very fine grain crystallographic structure. This improves the consistency of transverse properties of the lower end portion of the airfoil.

The filter 22 has upper and lower sides 26 and 28. The flat lower side 28 of the filter 22 extends parallel to the flat upper side 26 of the filter and to the horizontal upper side surface 16 of the chill plate 18. In the embodiment of the invention illustrated in FIG. 1, the filter 22 is supported above the chill plate 18 by the mold 10.

The filter 22 divides the starter chamber 14 into an upper portion 32 and a lower portion 34.

A plurality of parallel linear passages 38 (FIGS. 2 and 3) extend through the filter 22 between opposite sides 26 and 28 of the filter. The passages 38 have straight central axes which extend perpendicular to the sides 26 and 28 of the filter and parallel to a vertical longitudinal central axis of the airfoil mold cavity 12. The passages 38 have a rectangular cross sectional configuration. The filter 22 is extruded from a single piece of material with the passages 38 formed therein.

The filter 22 may be formed of many different materials, such as alumina, zircon, or zirconia. However, in the illustrated embodiment of the invention, the filter 22 is formed of mullite. The filter 22 is extruded with 476 passages 38 for each square inch of area of the upper and lower sides 26 and 28 of the filter 22. The filter passages 38 have a wall thickness of approximately 0.040 inches. Of course, the filter 22 could be formed with a greater or lesser number of passages 38 if desired.

In the illustrated embodiment of the invention, the filter 22 was obtained from NRG Ceramics Inc. of 418 Chinquapin Drive S.W., Marietta, Ga. under the designation of M5-476. However, it should be understood that filters other than this specific filter could be used if desired. For example, a reticulated ceramic foam filter having nonlinear passages could be used if desired. Other known types of filters could also be used.

Casting of Columnar Grained Airfoil

To cast a columnar grained airfoil, the mold 10 is placed on the chill plate 18 and raised into a furnace. The relationship between the furnace, chill plate and mold and the construction of the furnace may be the same as disclosed in U.S. Pat. Nos. 4,763,716; 4,862,947; 4,969,501 or 5,046,547. The mold 10 is then preheated, in a known manner in the furnace while it is supported on the chill plate 18. The mold 10 may be preheated to a temperature which is as high as 3,000° F.

Molten metal is then poured into a pour cup 42 (FIG. 1) which is connected in fluid communication with the airfoil mold cavity 12 through a sprue passage 44. Although a relatively simple relationship between the airfoil mold cavity 12, sprue passage 44 and pour cup 42 has been illustrated schematically in FIG. 1, it is contemplated that the mold 10 could have a much more complex construction and could include a substantial number of airfoil mold cavities connected in fluid communication with one or more pour cups through a substantial number of sprue passages. In one specific instance, the molten metal poured into the pour cup 42 was nickel-chrome superalloy RENE 108DS. Of course, other metals could be used if desired.

The molten metal is conducted downward from the sprue passage 44 into a blade portion 48 of the airfoil mold cavity 12. The molten metal continues to flow downward, under the influence of gravity, through a platform portion 50 and into a root portion 52 of the airfoil mold cavity. The molten metal then continues to flow downward from the airfoil mold cavity 12 into the upper portion 32 of the starter chamber 14.

The molten metal is conducted through the passages 38 (FIG. 2) in the filter 22 into the lower portion 34 of the starter chamber 14. The mold 10 grips the filter 12 to hold the filter stationary in the starter chamber 14. The molten metal flows through the filter 12 into engagement with the upper side surface 16 of the chill plate 18. The pouring of molten metal into the pour cup 42 is continued until the sprue passage 44, airfoil mold cavity 12, and starter chamber 14 are completely filled with molten metal.

The foregoing pouring of molten metal into the mold 10 occurs, in a known manner, in an evacuated furnace chamber. This minimizes the condensing of impurities in the lower portion 34 of the starter chamber 14 adjacent to the upper side surface 16 of the relatively cold chill plate 18. However, in spite of the fact that the mold 10 and the furnace chamber are evacuated prior to preheating and are maintained in an evacuated condition during pouring of molten metal into the mold, contaminants tend to collect in the relatively cool lower portion 34 of the starter chamber 14.

The chill plate 18 is then slowly lowered from the furnace. As the chill plate 18 is lowered, solidification of the molten metal in the lower portion 34 of the starter chamber 14 (FIG. 1) is initiated adjacent to the upper side surface 16 of the chill plate 18. Columnar grains, that is crystals, of metal solidify upwardly in the lower portion 34 of the starter chamber 14 into the passages 38 (FIGS. 2 and 3) in the filter 22. Impurities are trapped between the lower side surface 28 of the filter 22 and the upper side surface 16 of the chill plate 18.

Since the filter 22 blocks upward migration of the impurities as the molten metal in the lower portion 34 of the starter chamber 14 solidifies, relatively large inclusions 58 (FIG. 2) are formed in the metal in the lower portion of the starter chamber. Thus, the number of inclusions in the lower portion 34 of the starter chamber may be at least ten times as great as the number of inclusions in the airfoil mold cavity 12. In one specific casting, approximately 15 inclusions 58 were formed in the lower portion 34 of the starter chamber 14. These inclusions were of a relatively large size with the largest being approximately 0.060 square inches in cross-sectional area. In this particular casting, only one inclusion was formed in the airfoil mold cavity 12. The inclusion which was formed in the airfoil mold cavity was of relatively small size and had a cross-sectional area of 0.002 square inches or less.

Due to the relatively large heat gradient provided by the chill plate 18, columnar grain crystals which are most favorably oriented for upward growth enter the passages 38 in the filter 12. If more than one columnar grain crystal enters a passage 38 in the filter 12, the crystal which is most favorably oriented for upward growth crowds out the other crystal. Therefore, only the crystals which are most favorably oriented for upward growth in a direction parallel to the vertical central axes of the passages 38 emerge from the filter 22.

Since there are 476 passages per square inch of upper and lower side surface area of the filter 22, a large number of crystals will emerge from the upper side 26 of the filter 22. It should be understood that a crystal may grow upward through more than one passage 38 in the filter 12. However, the presence of the filter passages 38 promotes the growth of a large number of columnar grain crystals from the starter chamber 14 into the airfoil mold cavity 12.

Most of the crystals which emerge from the upper side 26 of the filter 22 grow into the airfoil mold cavity 12. To promote the growth of a relatively large number of columnar grain crystals into the airfoil mold cavity 12 from the starter chamber 14, the upper portion 32 of the starter chamber has a relatively short vertical extent. In one specific embodiment of the invention, the lower portion 34 of the starter chamber 14 had a vertical extent of approximately 0.5 inches, the filter 12 had a vertical extent of approximately 0.25 inches, and the upper portion 32 of the starter chamber had a vertical extent of approximately 0.25 inches.

The foregoing dimensions of one specific embodiment of the invention have been set forth for purposes of completeness of description. It is contemplated that different embodiments of the invention will have different dimensions. For example, the vertical extent of the upper portion 32 of the starter chamber 14 may be decreased and the vertical extent of the filter 12 increased. Thus, the filter 12 may have a vertical extent which is at least as great as a major portion of the vertical extent of the starter chamber 14.

As the chill plate 18 is slowly lowered from the furnace, the columnar grain crystals grow upwardly from the starter chamber 14 into the root portion 52 and platform portion 50 of the airfoil mold cavity 12. As the chill plate 18 continues to be lowered from the furnace, the columnar grains grow upwardly through the blade portion 48 of the airfoil mold cavity to the upper end of the airfoil mold cavity and sprue passage 46.

Since a relatively large number of columnar grains grow from the passages 38 in the filter 22 into the lower end portion of the airfoil mold cavity 12, the lower end portion, that is, the root portion, of an airfoil cast in the airfoil mold cavity 12 has a very fine columnar grain crystallographic structure. Thus, in one specific instance, approximately 400 columnar grains per square inch of cross-sectional area grew upward from the passages 38 in the filter 22 into the root portion 52 of the airfoil mold cavity. The construction of the filter 22 is such that more than 200 columnar grains per square inch of cross-sectional area of the root portion 52 of the airfoil mold cavity 12 solidify upward from the passages 38 in the filter 22. The number of grains which solidify upward from the filter 12 will vary depending upon the number of passages 38 in the filter and/or the location of the filter relative to the chill plate 16 and airfoil mold cavity 12.

The root portion 62 of a metal airfoil 64 cast in the airfoil mold cavity 12 has a very fine columnar grain crystallographic structure. The fine columnar grain crystallographic structure of the root portion 62 of the airfoil 64 has excellent transverse properties. The excellent transverse properties of the root portion 62 of the airfoil 64 (FIG. 2) cast in the airfoil mold cavity 12, are enhanced by the fact that there are no or only one or two very small inclusions formed in the root portion 62 of the airfoil 64. This is because the filter 22 blocks the migration of contaminants from the starter chamber 14 into the airfoil mold cavity 12.

After the chill plate 18 has been lowered from the furnace, the mold 10 is removed from the chill plate and cooled. The ceramic material of the mold 10 is then removed from around the casting which extends from the pour cup 42 through the airfoil mold cavity 12 and starter chamber 14 of the mold. The filter 22 is firmly locked in this one-piece metal casting by the metal which solidifies in the passages 38 in the filter.

The portion of the casting formed in the starter chamber 14, including the filter 22, is then cut off. The metal solidified in the sprue passage 44 and pour cup 42 is also cut off from the casting. The resulting airfoil 64 has a columnar grain crystallographic structure.

The lower end (as viewed in FIG. 2) of the root portion 62 of the airfoil 64 has more than 200 columnar grains per square inch of cross-sectional area of the root portion, as viewed in a plane extending perpendicular to the longitudinal central axis of the airfoil. In one specific instance, the end of the root portion 62 of the airfoil had approximately 400 columnar grains per square inch of cross-sectional area of the airfoil. In this particular instance, the root portion 62 had only one inclusion with an area of 0.002 square inches.

Figure 2:
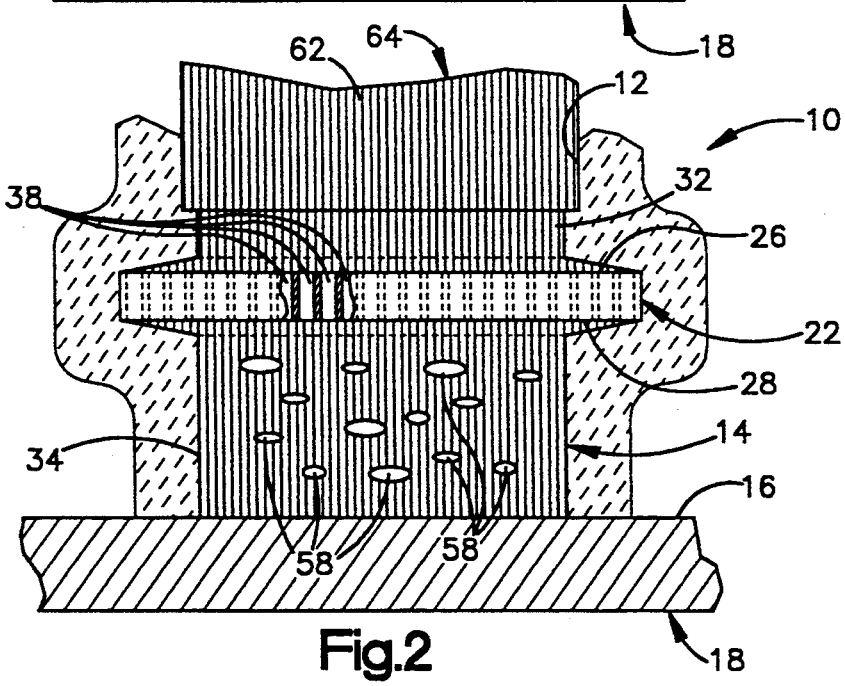
FIG. 2 is an enlarged fragmentary schematic sectional view of a portion of FIG. 1 and illustrating the manner in which molten metal solidifies upward from a chill plate, through passages in a filter, and into an airfoil mold cavity.
Figure 3:
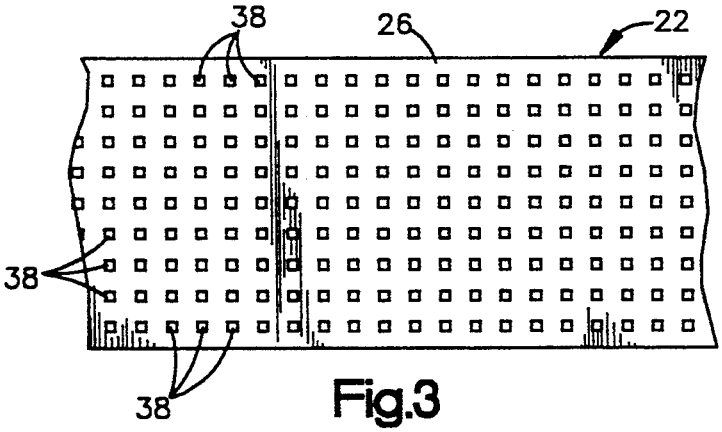
FIG. 3 is a top plan view of a portion of the filter of FIG. 2 and illustrates linear passages which extend between opposite sides of the filter.

An examination of the metal which solidified in the lower portion 34 of the starter chamber 14 revealed approximately 15 inclusions 58 (FIG. 2). The largest of the inclusions 58 in the metal which solidified in the lower portion 34 of the starter chamber 14 had a cross-sectional area of approximately 0.060 square inches. By forming at least the lower end of the root portion 62 of the airfoil 64 with a very fine columnar grain crystallographic structure, that is more than 200 columnar grains per square inch of cross-sectional area, and very few or no inclusions, the transverse properties of the root portion 62 of the airfoil 64 are enhanced.

Although it is preferred to cast the airfoil 64 with the root portion 62 downward, the airfoil could be cast with the root portion upward. If this was done, the fine columnar grain crystallographic structure would be obtained in the end portion of the airfoil opposite from the root portion.

Forming Mold

In order to form the mold 10, a wax pattern 70 (FIG. 4) is formed. The wax pattern 70 includes a pour cup and sprue passage pattern section 72, an airfoil pattern section 74, and a starter chamber pattern section 76. The filter 22 is disposed in the starter chamber pattern section 76. The filter 22 has a larger cross sectional area, as viewed on a plane extending perpendicular to a longitudinal central axis of the wax pattern 70, than the starter chamber pattern section 76. This results in the filter 22 projecting outward past side surfaces of the starter chamber pattern section 76.

The exposed minor side surfaces of the filter 22 are sealed with a coating of lacquer. Exposed areas of the upper and lower sides 26 and 28 of the filter 22 are blocked with a thin layer of wax.

Although the airfoil pattern section 74 could be formed separately from the starter chamber pattern section 6 and the filter 22, it is preferred to simultaneously form the airfoil pattern section 74 and the starter chamber pattern section 76 with the filter 22 in the starter chamber pattern section. To accomplish this, natural or artificial wax is injected into an airfoil pattern mold cavity and into a starter chamber pattern mold cavity. Once the wax has been injected into the pattern mold cavities and solidified, a unitary airfoil pattern section and starter chamber pattern section with the filter disposed therein is formed. The pour cup and sprue passage pattern section 72 is then connected with the airfoil pattern section 74.

Figure 4:
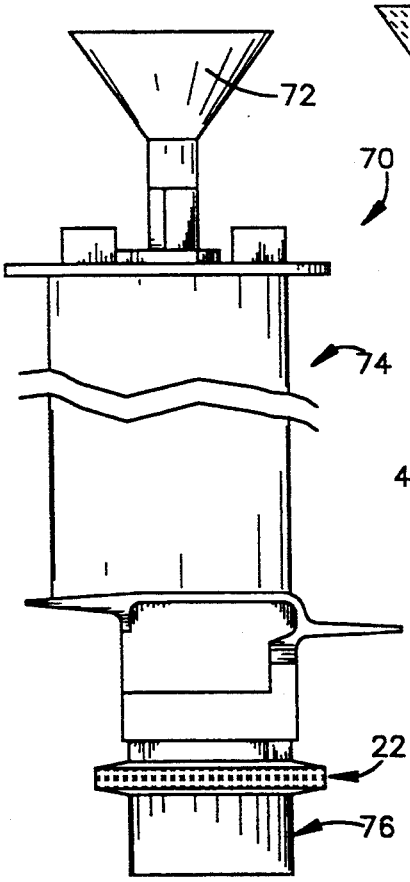
FIG. 4 is a schematic illustration of a pattern used to form the mold of FIG. 1.

The pour cup and sprue passage pattern section 72 illustrated in FIG. 4 is relatively simple in construction. It is contemplated that a plurality of airfoil pattern sections may be connected with a single pour cup pattern by a plurality of sprue passage pattern sections in a known manner.

In order to form the mold 10, the wax pattern 70 is completely covered with liquid ceramic mold material. Although many different types of ceramic mold material could be utilized, one specific ceramic mold material contains fused silicon, zircon, and other refractory materials in combination with binders. Chemical binders such as ethyl silicate, sodium silicate, and colloidal silica may be utilized. In addition, the slurry may contain suitable film formers, such as alginates, to control viscosity and wetting agents to control flow characteristics and pattern wettability.

The wet covering of ceramic mold material may be wiped away from the upper end (as viewed in FIG. 4) of the pour cup and sprue pattern section 72 and from the lower end (as viewed in FIG. 4) of the starter chamber pattern section 76. The wet covering of ceramic mold material overlies the portion of the filter 12 which projects outwardly from the starter pattern section 76. The projecting portion of the filter 12 is sealed by lacquer and/or wax to prevent the ceramic mold material from entering passages 38 in the filter 12.

After the ceramic mold material is at least partially dried, the mold 10 is heated to melt the wax material of the pattern 70. The melted wax material is conducted out of the mold through one or both open ends of the mold. The ceramic mold material grips the filter 22 to hold the filter stationary in the starter chamber 14. The mold 10 is then fired at a temperature of approximately 1,900° F. for a time sufficient to cure the mold.

During firing of the mold, the mold is advantageously positioned with the pour cup 42 downward and the filter 22 upward. This results in any stray ceramic particles which may fall into the mold through the open end of the starter chamber 34 being blocked by the filter 22 from entering the airfoil mold cavity 12. In addition, any ceramic particles which may be loose in the airfoil mold cavity 12 tend to fall out of the mold cavity through the open end of the pour cup 42. The general manner in which ceramic molds of this type are formed is well known and will not be further described herein to avoid prolixity of description.

Bottom Fill Mold

The mold 10 of FIG. 1 is of the top fill type in which the molten metal enters the airfoil mold cavity from the upper end of the airfoil mold cavity. However, the present invention may be used with a bottom fill type of mold, illustrated in FIG. 5. Since the embodiment of the invention illustrated in FIG. 5 is generally similar to the embodiment of the invention illustrated in FIG. 1, similar numerals will be utilized in association with similar components, the suffix letter "a" being added to the numerals of FIG. 5 to avoid confusion.

The mold **10*a* includes an airfoil mold cavity 12*a* and a starter chamber 14*a*. The lower end of the starter chamber 14*a* is defined by an upper side surface 16*a* of a chill plate 18*a*. In accordance with the present invention, a filter 22*a* is disposed in the starter chamber 14*a*. The filter 22*a* has the same construction as the filter 22 of FIGS. 1–3**.

Figure 5:
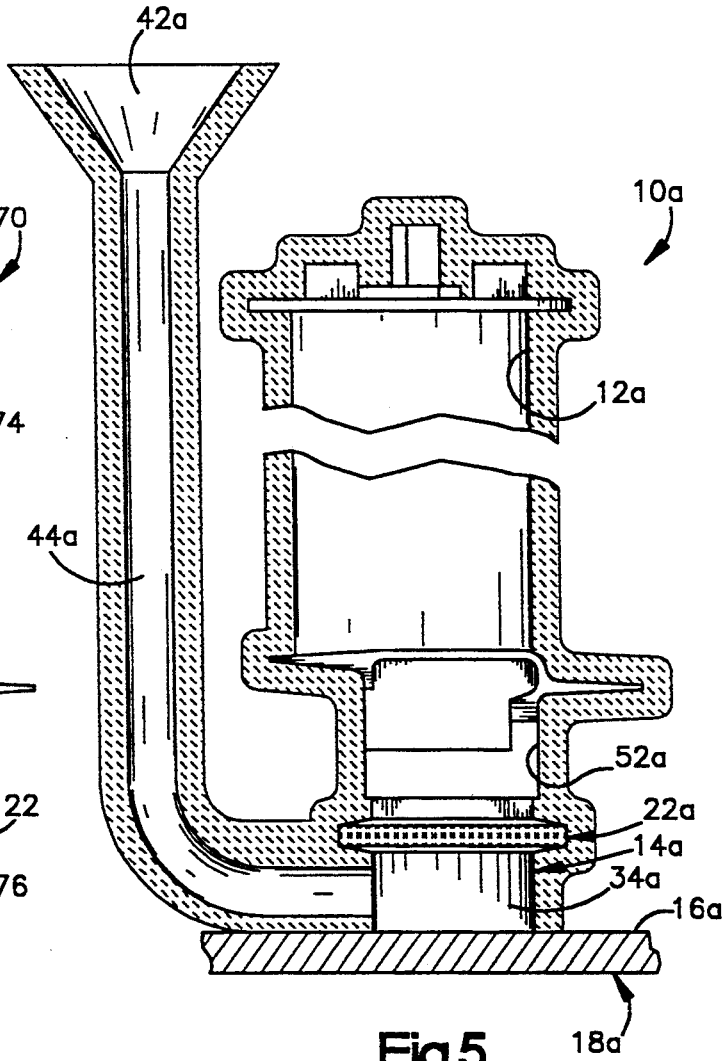
FIG. 5 is a schematic sectional view of a bottom fill mold having a filter in a starter chamber.

In accordance with a feature of the embodiment of the invention illustrated in FIG. 5, the mold **10*a* is of the bottom fill type. Thus, molten metal is conducted from a pour cup 42*a* through a sprue passage 44*a* into a lower portion 34*a* of the starter chamber 14*a*. The molten metal flows upward through the filter 22*a* and into the airfoil mold cavity 12*a*. The ceramic material of the mold 10*a* holds the filter 22*a* stationary in the starter chamber 14*a*. Suitable vents (not shown) are connected with the upper end portion of the airfoil mold cavity 12*a***.

The filter **22*a* blocks the passage of contaminants into the airfoil mold cavity 12*a*. Thus, the molten metal flows from the sprue passage 44*a* upward through the filter 22*a* into the airfoil mold cavity 12*a*. This enables the filter 22*a* to block entry of contaminants into the airfoil mold cavity 12*a***.

Once the airfoil mold cavity **12*a* and starter chamber 14*a* have been completely filled with molten metal, the chill plate 18*a* is slowly lowered from the furnace. As this occurs, the molten metal is initially solidified adjacent to the upper side surface 16*a* of the chill plate 18*a*. Columnar grains of the molten metal solidify upwardly into the passages in the filter 22*a*. Any contaminants which accumulate adjacent to the upper side surface 16*a* of the chill plate 18*a* are blocked from migrating upward into the airfoil mold cavity 12*a* by the filter 22*a***.

As the molten metal continues to solidify, columnar grains of molten metal solidify upward from the passages in the filter **22*a* into the root portion 52*a* of the airfoil mold cavity 12*a* to provide the cast airfoil with a very fine grain crystallographic structure. Thus, the root portion of the airfoil cast in the airfoil mold cavity 12*a* will have more than 200 columnar grains per square inch of cross-sectional area as viewed in a plane perpendicular to a longitudinal central axis of the airfoil. When the filter 22*a*** has 476 passages per square inch of cross sectional area, the lower end of the root portion of the airfoil is formed with approximately 400 columnar grains per square inch of cross-sectional area. The relatively fine columnar grain crystallographic structure and the lack of inclusions due to impurities in the root portion of the airfoil improves the transverse properties of the root portion of the airfoil.

Figure 6:
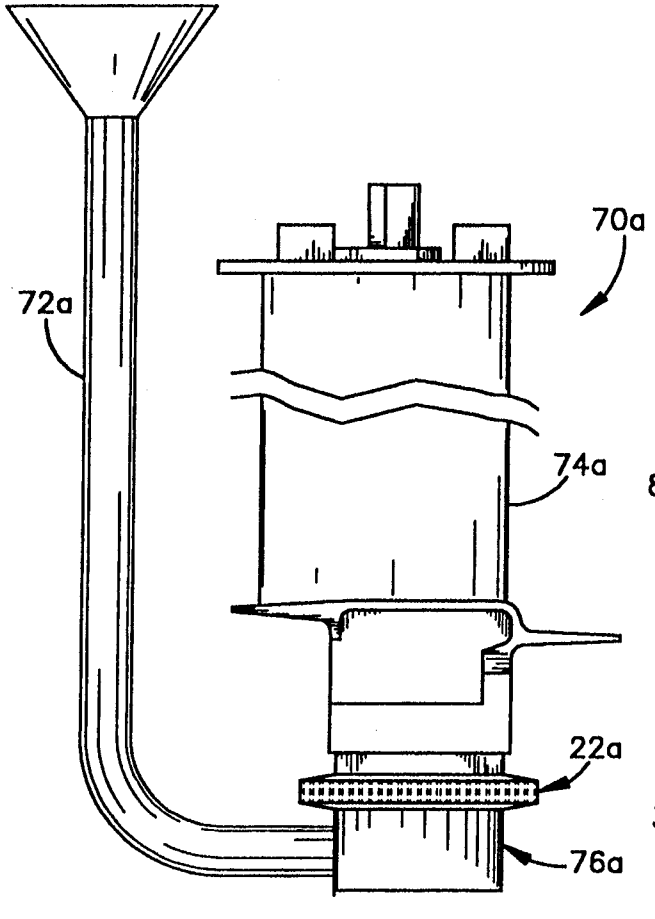
FIG. 6 is a schematic illustration of a pattern used to form the bottom fill mold of FIG. 5.

The mold **10*a* is formed from a pattern 70*a* (FIG. 6). The pattern 70*a* is formed of either natural or synthetic wax and includes a pour cup and sprue pattern section 72*a*. The pour cup and sprue pattern section 72*a* is connected with a starter chamber pattern section 76*a* in which the filter 22*a* is disposed. An airfoil pattern section 74*a* is connected with the starter chamber pattern section 76*a*. The mold 10*a* is formed by covering the pattern 70*a* with ceramic mold material in the same manner as previously discussed in conjunction with the embodiment of the invention shown in FIGS. 1–4**.

Molds for Single Crystal Airfoils

Figure 8:
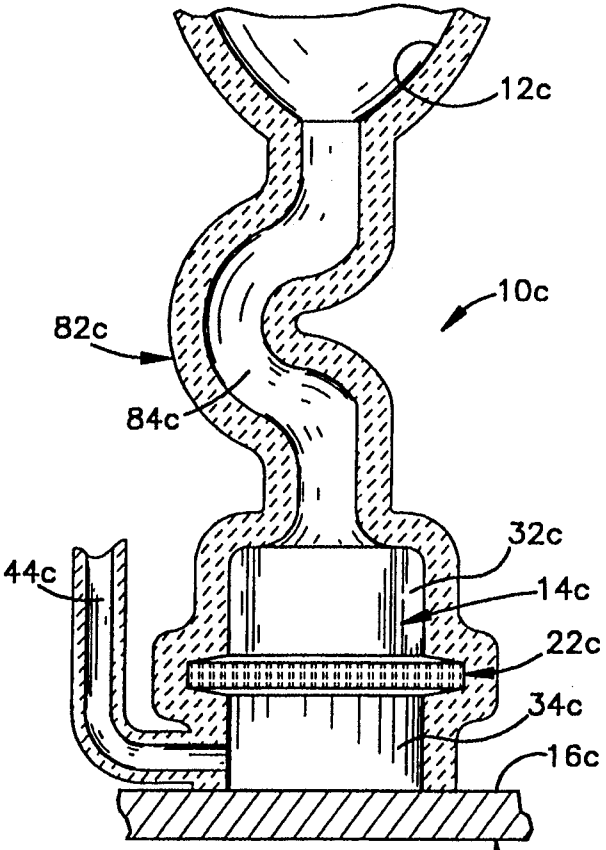
FIG. 8 is a fragmentary schematic sectional view of a portion of a bottom fill mold which is used to cast a single crystal airfoil.
Figure 7:
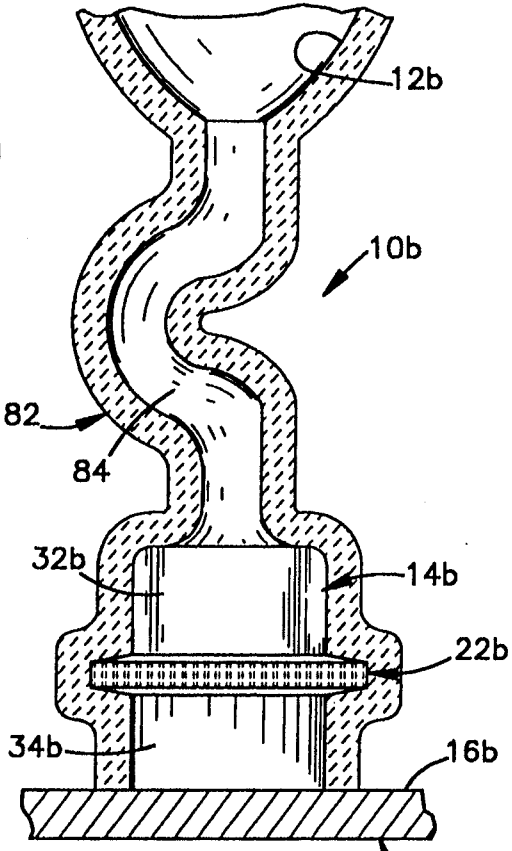
FIG. 7 is a fragmentary schematic sectional view of a portion of a top fill mold which is used to cast a single crystal airfoil and illustrating the relationship between a filter and a single crystal selector.

The molds 10 and **10*a* of the embodiment of the invention illustrated in FIGS. 1 and 5 are used to cast airfoils with a columnar grain crystallographic structure. However, it is contemplated that the present invention may be used in conjunction with the casting of airfoils having a single crystal crystallographic structure. FIGS. 7 and 8 relate to embodiments of an improved mold in which single crystal airfoils are cast. Since the embodiments of the invention of FIGS. 7 and 8 are generally similar to the embodiments of the invention illustrated in FIGS. 5 and 6, similar numerals will be utilized to designate similar components, the suffix letter "b" being associated with the numerals of the embodiment of FIG. 7 and the suffix letter "c" being associated with the numerals of the embodiment of FIG. 8**.

A mold **10*b* (FIG. 7) is used to cast a single crystal airfoil. The mold 10*b* includes an airfoil mold cavity 12*b* which is connected in communication with a starter chamber 14*b* through a single crystal selector 82. The single crystal selector 82 has a crystal selector passage 84 into which a plurality of columnar grains of metal grow from the starter chamber 14*b***.

As the plurality of grains which enter the crystal selector passage 84 continue to grow, the most favorably oriented grain or crystal grows at a greater rate than the other grains or crystals. Therefore, the most favorably oriented grain or crystal crowds out the less favorably oriented grains. This results in a single grain or crystal, which is most favorably oriented, growing from the crystal selector passage 84 into the airfoil mold cavity 12b.

The single grain or crystal which emerges from the crystal selector passage 84 into the airfoil mold cavity 12b solidifies to completely fill the airfoil mold cavity. The single crystal of metal which solidifies in the airfoil mold cavity 12b has a configuration corresponding to the desired configuration of the airfoil. The molten metal in the sprue passage and pour cup (not shown) connected with the airfoil mold cavity 12b then solidifies. During solidification of the molten metal in the sprue passage and/or pour cup, additional crystals may nucleate.

Although many different types of crystal selectors 82 may be utilized, in one specific embodiment of the invention, the crystal selector 82 had the same construction as is disclosed in U.S. Pat. No. 5,062,468.

In accordance with a feature of the present invention, a filter 22b is disposed in the starter chamber 14b. The filter 22b has the same construction as the filter 22 of the embodiment of the invention illustrated in FIGS. 1–4. The use of the filter 22b results in any impurities which may accumulate adjacent to an upper side surface 16b of a chill plate 18b being retained in a lower portion 34b of the starter chamber 14b.

In addition, the use of the filter 22b promotes the solidification of the molten metal in the upper portion 32b of the starter chamber 14b as a large number of columnar grains. Therefore, the large majority of the columnar grains which enter the single crystal selector passage 84 will be favorably oriented for vertical (as viewed in FIG. 7) growth. As the grains grow along the curving single crystal selector passage 84, a most favorably oriented grain will crowd out the other grains and grow into the airfoil mold cavity 12b.

In the embodiment of the invention illustrated in FIG. 7, the mold 10b is of the top fill type in which molten metal is conducted from the pour cup downwardly through a sprue passage into the airfoil mold cavity 12b. The molten metal is then conducted through the single crystal selector 82 into the starter chamber 14b. The embodiment of the invention shown in FIG. 8 is in association with a bottom fill type of mold. Thus, mold 10c has an airfoil mold cavity 12c which is connected with a starter chamber 14c through a passage 84c in a single crystal selector 82c.

Molten metal is conducted directly into the lower portion 34c of the starter chamber 14c through a sprue passage 44c. The sprue passage 44c is connected in fluid communication with a suitable pour cup (not shown). As the mold 10c is filled with molten metal, the molten metal rises upward through the filter 22c into the upper portion 32c of the starter chamber 14c. The molten metal then moves upward through the crystal selector passage 84c into the airfoil mold cavity 12c. Once the airfoil mold cavity 12c, single crystal selector 82c and starter chamber 14c have been completely filled with molten metal, the chill plate 18c is slowly lowered from a furnace.

As the chill plate 18c is slowly lowered from the furnace, the molten metal in the lower portion 34c of the starter chamber 14c solidifies. As this occurs, the filter 22c blocks migration of impurities which have accumulated adjacent to the upper side surface 16c of the chill plate 18c into the upper portion 32c of the starter chamber 14c.

The filter 22c has the same construction as the filter 22 of FIGS. 1–4. Therefore, the molten metal solidifies upwardly from the filter 22c with a columnar grained crystallographic structure. A plurality of the columnar grains enter the crystal selector passage 84c. The most favorably oriented grain or crystal emerges from the crystal selector passage 84c and solidifies as a single crystal in the airfoil mold cavity 12c.

Mold—Fifth Embodiment

Figures 9, 10, 11:
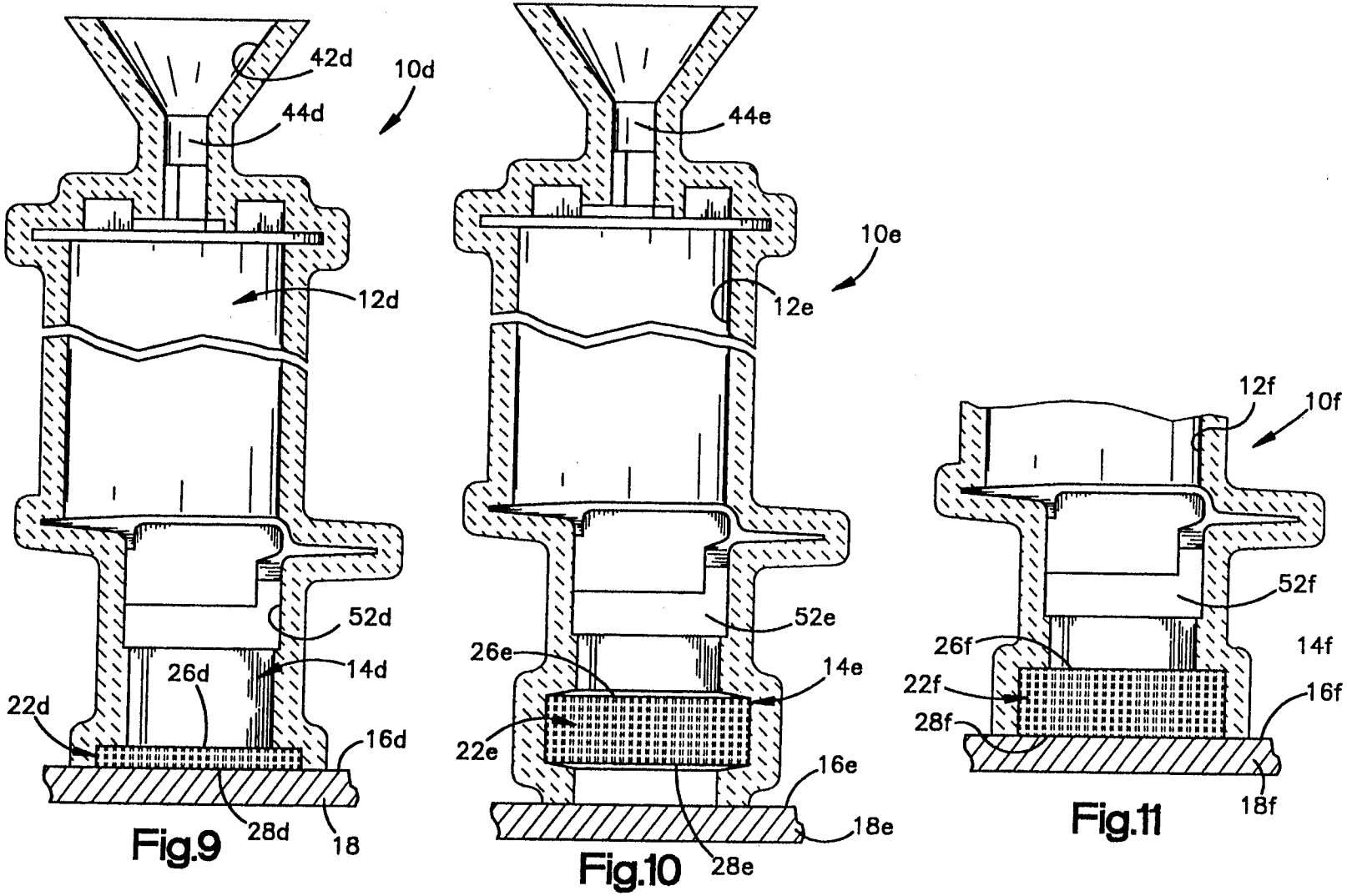
FIG. 9 is a schematic sectional view, generally similar to FIG. 1, illustrating a mold in which a filter is placed in engagement with a chill plate at a lower end of the mold.
FIG. 10 is a schematic sectional view, generally similar to FIG. 1, illustrating a mold having a relatively thick filter.
FIG. 11 is a schematic fragmentary sectional view illustrating a mold having a filter which completely fills a starter chamber.

In the embodiment of the invention illustrated in FIGS. 1–4, the filter 22 is disposed above the upper side surface 16 of the chill plate 18. In the embodiment of the invention illustrated in FIG. 9, the filter is placed in engagement with the upper side of the chill plate. Since the embodiment of the invention illustrated in FIG. 9 is generally similar to the embodiment of the invention illustrated in FIGS. 1–4, similar numerals will be utilized to designate similar components, the suffix letter "d" will be associated with the numerals of FIG. 9 to avoid confusion.

An improved mold 10d (FIG. 9) is used to cast an improved airfoil having a columnar grain crystallographic structure. The mold 10d includes an airfoil mold cavity 12d and a starter chamber 14d. The mold 10d is supported on an upper side surface 16d of a chill plate 18d.

In accordance with a feature of this embodiment of the invention, a filter 22d is positioned in the starter chamber 14d in engagement with the chill plate 18d. Thus, a flat lower side 28d of the filter 22d is placed in abutting engagement with the upper side 16d of the chill plate 18d. A flat upper side 26d of the filter 22d is exposed to the lower end portion of the airfoil mold cavity 12d through the starter chamber 14d.

The filter 22d has the same construction as the filter 22 of FIGS. 1–4. Although the filter 22d has been shown as being substantially smaller in vertical extent than the starter chamber 14d, it is contemplated that the filter 22d may have a greater vertical extent than the filter 22 of FIGS. 1–4.

Once the starter chamber 14d, airfoil mold cavity 12d and sprue passage 44d have been completely filled with molten metal, the chill plate 18d is slowly lowered from the furnace. As this occurs, the molten metal is initially solidified adjacent to the upper side surface 16d of the chill plate 18d. The molten metal solidifies upward through the passages in the filter 22d. As the chill plate 18d continues to be lowered, the molten metal solidifies, with a columnar grain crystallographic structure, upward into the open lower end of the root portion 52d of the airfoil mold cavity. As this occurs, the filter 22d prevents migration of impurities upward into the airfoil mold cavity 12d.

The filter 22d has a relatively large number of vertically extending linear passages through which the molten metal solidifies upward with a columnar grain crystallographic structure. In one specific instance, the filter 22d had 476 passages per square inch of surface area of the lower side 28d and upper side 26d of the filter. This resulted in more than 200 columnar grains per square inch of cross-sectional area entering the root portion 52d of the airfoil mold cavity 12d. The resulting relatively fine grain root portion of the airfoil cast in the airfoil mold cavity 12d had enhanced transverse properties. The properties of the airfoil cast in the airfoil mold cavity 12d were also enhanced by the fact that very few, if any, inclusions were formed in the airfoil due to the retention of impurities in the starter chamber 14d by the filter 22d.

Mold—Sixth Embodiment

In the embodiment of the invention illustrated in FIGS. 1–4, the filter 22 has a relatively small thickness or vertical extent as compared to the vertical extent of the starter chamber 14. In the embodiment of the invention illustrated in FIG. 10, the filter is relatively thick. Since the embodiment of the invention illustrated in FIG. 10 is generally similar to the embodiment of the invention illustrated in FIGS. 1–4, similar numerals will be utilized to designate similar components, the suffix letter "e" will be associated with the numerals of FIG. 10 to avoid confusion.

An improved mold 10e is used to cast an improved airfoil having a columnar grain crystallographic structure. The mold 10e includes an airfoil mold cavity 12e and a starter chamber 14e. The mold 10e is supported on an upper side surface 16e of a chill plate 18e.

In accordance with a feature of this embodiment of the invention, a filter 22e is relatively thick. Thus, the vertical distance between a flat lower side 28e and a flat upper side 26e of the filter 22e is relatively large. The lower side 28e of the filter 12e is spaced from and extends parallel to the flat upper side 16e of the chill plate 18e. The upper side 28e of the filter is disposed a short distance below the lower end of the root portion 52e of the airfoil mold cavity 12e. The filter 12e occupies a major portion of the volume of the starter chamber 14e.

The filter 22e has the same construction as the filter 22 of FIGS. 1–4. By forming the filter 22e with a relatively large vertical extent, the metal crystals which solidify in the starter chamber 14e and are most favorably oriented for vertical growth, have a shorter distance in which to crowd out less favorably oriented crystals. Once the crystals have entered the linear passages in the filter 22e, a crystal in one passage cannot crowd out a less favorably oriented crystal in an adjacent passage.

Once the starter chamber 14e, airfoil mold cavity 12e and sprue passage 44e have been completely filled with molten metal, the chill plate 18e is slowly lowered from the furnace. As this occurs, the molten metal is initially solidified adjacent to the upper side surface 16e of the chill plate. The molten metal then solidifies upward through the passages in the filter 22e. As the chill plate continues to be lowered, the molten metal solidifies, with a columnar grain crystallographic structure, upward into the open lower end of the root portion 52e of the airfoil mold cavity. As this occurs, the filter 22e prevents migration of impurities upward into the airfoil mold cavity 12e.

The filter 22e has a relatively large number of relatively long and vertically extending linear passages through which the molten metal solidifies upward with a columnar grain crystallographic structure. In one specific embodiment, the filter 22e has 476 passages per square inch of surface area of the lower side 28e and upper side 26e of the filter. The linear passages through the filter 22e have a length of approximately 0.625 inches. In this specific embodiment, the lower side 28e of the filter of the filter 22e is spaced approximately 0.1875 inches from the upper side 16e of the chill plate 18e. The upper side 26e of the filter 22e is spaced approximately 0.1875 inches from the airfoil mold cavity 12e.

This construction of the mold 10e results in more than 200 columnar grains per square inch of cross-sectional area entering the root portion 52e of the airfoil mold cavity 12e. The resulting relatively fine grain root portion of the airfoil cast in the airfoil mold cavity 12e has enhanced transverse properties. The properties of the airfoil cast in the airfoil mold cavity 12e are also enhanced by the fact that very few, if any, inclusions are formed in the airfoil due to the retention of impurities in the starter chamber 14e by the filter 22e.

It should be understood that the foregoing specific dimensions for the filter 22e and the distances between the lower side 28e and upper side 26e of the filter and the chill plate 18e and airfoil mold cavity 12e have been set forth herein for purposes of completeness of description. It is contemplated that different embodiments of the invention will have different dimensions.

Mold—Seventh Embodiment

In the embodiment of the invention illustrated in FIGS. 1–4, the filter 22 is relatively thin and is disposed above the upper side surface 16 of the chill plate 18. In the embodiment of the invention illustrated in FIG. 11, the filter engages the upper side of the chill plate and occupies the entire starter chamber. Since the embodiment of the invention illustrated in FIG. 11 is generally similar to the embodiment of the invention illustrated in FIGS. 1–4, similar numerals will be utilized to designate similar components, the suffix letter "f" will be associated with the numerals of FIG. 11 to avoid confusion.

An improved mold 10f is used to cast an improved airfoil having a columnar grain crystallographic structure. The mold 10f includes an airfoil mold cavity 12f and a starter chamber 14f. The mold 10f is supported on an upper side surface 16f of a chill plate 18f.

In accordance with a feature of this embodiment of the invention, a filter 22f fills the starter chamber 14f. Thus, the vertical distance between a flat upper side surface 26f and a flat lower side surface 28f is the same as the vertical height of the starter chamber 14f. The flat upper side surface 26f of the filter 22f is disposed at the lower end of the airfoil mold cavity 12f. The flat lower side surface 28f of the filter 22f is disposed in engagement with the horizontal upper side 16f of the chill plate 18f.

The filter 22f has the same construction as the filter 22 of FIGS. 1–4. Since the filter 22f fills the starter chamber 14f, a single columnar grain crystal grows upwardly from the chill plate 18f through each of the linear vertical filter passages into the airfoil mold cavity 12f. Thus, one end of each filter passage is at the upper side surface 16f of the chill plate 18f and the opposite end of each filter passage is at the entrance to the airfoil mold cavity 12f.

Once the starter chamber 14f, airfoil mold cavity 12f and sprue passage for the mold 10f have been completely filled with molten metal, the chill plate 18f is slowly lowered from the furnace. As this occurs, the molten metal is initially solidified in each of the passages in the filter 22f adjacent to the upper side surface 16f of the chill plate 18f. The molten metal solidifies upward through the passages in the filter 22f. As the chill plate 18f continues to be lowered, a single columnar grain crystal solidifies upward from each of the passages in the filter 22f into the open lower end of the root portion 52f of the airfoil mold cavity. As this occurs, the filter 22f prevents migration of impurities upward into the airfoil mold cavity 12f.

The filter 22f has a relatively large number of vertically extending linear passages through which the molten metal solidifies upward with a columnar grain crystallographic structure. In one specific instance, the filter 22*f* had 476 passages per square inch of surface area of the lower side 28*f* and upper side 26*f* of the filter. This resulted in more than 476 columnar grains per square inch of cross-sectional area entering the root portion 52*f* of the airfoil mold cavity 12*f*. The resulting very fine grain root portion of the airfoil cast in the airfoil mold cavity 12*f* had enhanced transverse properties. The properties of the airfoil cast in the airfoil mold cavity 12*f* were also enhanced by the fact that very few if any inclusions were formed in the airfoil due to the retention of impurities in the starter chamber 14*f* by the filter 22*f*.

Conclusion

In view of the foregoing description, it is apparent that the present invention provides a new and improved method and apparatus for use in casting an airfoil. In accordance with a feature of the invention, a filter 22 is provided in a starter chamber 14. The filter blocks 22 migration of impurities from the starter chamber 14 into the airfoil mold cavity 12. In addition, during the casting of columnar grain airfoils, the filter 22 causes the molten metal in the starter chamber 14 to solidify into the airfoil mold cavity as a relatively large number columnar grains.

Having described the invention, the following is claimed:

1. A method of casting a metal airfoil in a mold having an airfoil mold cavity and a starter chamber which is partially defined by the mold and is partially defined by a chill plate, said method comprising the steps of conducting molten metal into the starter chamber, into passages in a filter disposed in the starter chamber, and into the airfoil mold cavity, solidifying the molten metal in the starter chamber, said step of solidifying molten metal in the starter chamber including solidifying molten metal in the passages in the filter in a direction away from the chill plate, and, thereafter, solidifying the molten metal in the airfoil mold cavity.

2. A method as set forth in claim 1 further including the step of blocking movement of impurities from the starter chamber into the airfoil mold cavity with the filter.

3. A method as set forth in claim 1 wherein said step of solidifying the molten metal in the starter chamber includes solidifying a plurality of grains of metal from the chill plate through passages in the filter.

4. A method as set forth in claim 1 wherein said steps of solidifying molten metal in the starter chamber and airfoil mold cavity include initiating solidification of a plurality of grains of metal adjacent to the chill plate and solidifying grains of metal through the filter and into the airfoil mold cavity.

5. A method as set forth in claim 1 wherein said step of conducting molten metal into the starter chamber, into passages in a filter, and into the airfoil mold cavity includes first conducting a flow of the molten metal through the airfoil mold cavity and then conducting the molten metal into the starter chamber.

6. Method as set forth in claim 1 wherein said step of conducting molten metal into the starter chamber, into passages in a filter and into the airfoil mold cavity includes first conducting a flow of molten metal through the starter chamber and then conducting the molten metal into the airfoil mold cavity.

7. A method as set forth in claim 1 wherein said step of conducting molten metal into the starter chamber, into passages in a filter, and into the airfoil mold cavity includes first conducting the molten metal through the airfoil mold cavity and then conducting the molten metal into passages in the filter.

8. A method as set forth in claim 1 wherein said step of conducting molten metal into the starter chamber, into passages in a filter, and into the airfoil mold cavity includes first conducting the molten metal into the starter chamber and then conducting molten metal into passages in the filter.

9. A method as set forth in claim 1 wherein said step of solidifying molten metal in the airfoil mold cavity includes solidifying the molten metal in the airfoil mold cavity as a single crystal of metal.

10. A method as set forth in claim 1 further including the steps of conducting molten metal into a single crystal selector and solidifying the molten metal in the single crystal selector before solidifying the molten metal in the airfoil mold cavity.

11. A method as set forth in claim 1 wherein said step of solidifying the molten metal in the passages in the filter includes solidifying the molten metal in a plurality of linear filter passages which extend from one side of the filter to an opposite side of the filter.

12. A method as set forth in claim 1 wherein the filter is disposed in the starter chamber in a spaced apart relationship with the chill plate, said step of solidifying molten metal in the starter chamber includes first solidifying molten metal between the chill plate and the filter and then solidifying molten metal in the passages in the filter.

13. A method as set forth in claim 1 wherein said step of conducting molten metal into the starter chamber, into passages in a filter, and into the airfoil mold cavity includes first conducting the molten metal upwardly through the filter and then conducting the molten metal upwardly to the airfoil mold cavity.

14. A method as set forth in claim 1 wherein said step of conducting molten metal into the starter chamber, into passages in a filter and into the airfoil mold cavity includes first conducting the molten metal downwardly through the airfoil mold cavity and then conducting the molten metal downwardly through the filter.

15. An apparatus for use in casting a metal airfoil, said apparatus comprising a chill plate, a mold disposed on said chill plate, said mold including first surface means for defining an airfoil mold cavity and second surface means for cooperating with said chill plate to define a starter chamber, and a filter disposed in said starter chamber between said airfoil mold cavity and said chill plate.

16. An apparatus as set forth in claim 15 wherein said filter includes first and second major side surfaces and an array of linear passages which extend between said first and second side surfaces of said filter.

17. An apparatus as set forth in claim 15 wherein said filter is formed of reticulated foam.

18. An apparatus as set forth in claim 15 wherein said filter includes a flat major side surface area disposed in abutting engagement with said chill plate.

19. An apparatus as set forth in claim 15 wherein said filter has a first major side surface area which faces toward and is spaced from said chill plate, a second major side surface area which faces away from said chill plate, and a plurality of passages which extend between said first and second major side surface areas of said filter.

20. An apparatus as set forth in claim 19 wherein said first major side surface area of said filter is spaced from said chill plate by a distance which is greater than the distance between said first and second major side surface areas of said filter.

21. An apparatus as set forth in claim 15 wherein said filter contains more than two hundred passages per square inch of a side surface area which faces toward said chill plate.

22. An apparatus as set forth in claim 15 further including passage means for conducting molten metal into an upper end portion of said article mold cavity.

23. An apparatus as set forth in claim 15 further including passage means formed separately from said airfoil mold cavity for conducting molten metal into said starter chamber.

24. An apparatus as set forth in claim 15 further including single crystal selector means disposed between said starter chamber and said airfoil mold cavity for enabling only a single crystal of metal to solidify from said starter chamber into said airfoil mold cavity.

25. An apparatus as set forth in claim 15 wherein said filter is engaged by said mold to retain said filter against movement relative to said mold.

26. An apparatus as set forth in claim 15 wherein said filter includes a lower side surface area which is disposed in said starter chamber above and faces toward said chill plate and an upper side surface area which is disposed in said starter chamber and faces toward said airfoil mold cavity, said filter having more than 200 passages per square inch of said upper and lower side surface areas and which extend between said upper and lower side surface areas.

27. An apparatus as set forth in claim 15 wherein said airfoil mold cavity is entirely disposed above said filter.

28. An apparatus as set forth in claim 15 wherein said filter occupies at least a major portion of the volume of said starter chamber.

29. An apparatus as set forth in claim 15 wherein said filter has a first major side surface area which faces toward and is spaced from said chill plate and a second major side surface area which faces away from said chill plate, said first and second major side surfaces areas being spaced apart by a first distance, said first major side surface area of said filter being spaced apart from said chill plate by a second distance which is greater than said first distance.

30. An apparatus as set forth in claim 15 wherein said filter has a first major side surface area which faces toward and is spaced from said chill plate and a second major side surface area which faces away from said chill plate, said first and second major side surface areas of said filter being spaced apart by a first distance, said first major side surface area of said filter being spaced apart from said chill plate by a second distance which is less than said first distance.

31. An apparatus as set forth in claim 15 wherein said starter chamber is at least almost completely filled by said filter.

32. An apparatus for use in casting a metal airfoil, said apparatus comprising a wax pattern having a first portion with a configuration corresponding to the configuration of the metal airfoil and a second portion which is connected with said first portion and has configuration corresponding to the configuration of a starter chamber, and a filter connected directly with said second portion of said wax pattern.

33. An apparatus as set forth in claim 32 wherein said filter includes surface means for defining a plurality of linear passages having central axes which extend parallel to a longitudinal central axis of said first portion of said wax pattern.

34. An apparatus as set forth in claim 32 wherein said second portion of said wax pattern has a first end which is exposed and a second end which is integrally formed as one piece with said first portion of said wax pattern, said filter being disposed between said first and second ends of said second portion of said wax pattern.

35. An apparatus as set forth in claim 32 wherein said wax pattern has a third portion which is connected with an end of said first portion opposite from said second portion of said wax pattern, said third portion of said wax pattern having a configuration corresponding to the configuration of a passage through which molten metal is conducted into an airfoil mold cavity having a configuration corresponding to the configuration of the first portion of said wax pattern.

36. An apparatus as set forth in claim 32 wherein said wax pattern has a third portion which is connected with said second portion of said wax pattern and is spaced from said first portion of said wax pattern, said third portion of said wax pattern having a configuration corresponding to the configuration of a passage through which molten metal is conducted into a starter chamber of a mold in which the airfoil is cast.

37. A method of casting a metal airfoil in a mold having an airfoil mold cavity and a starter chamber which is partially defined by a chill plate, said method comprising the steps of conducting molten metal into the starter chamber and the airfoil mold cavity, initiating solidification of the molten metal in the starter chamber adjacent to the chill plate, solidifying the molten metal in the starter chamber, blocking migration of impurities from the starter chamber to the airfoil mold cavity with a filter disposed between the chill plate and the airfoil mold cavity during solidification of the molten metal in at least a portion of the starter chamber, and, thereafter, solidifying molten metal in the airfoil mold cavity.

38. A method as set forth in claim 37 wherein said step of solidifying the molten metal in the starter chamber includes solidifying molten metal in a plurality of passages in the filter, said step of solidifying molten metal in the airfoil mold cavity includes solidifying at least a portion of the molten metal in the airfoil mold cavity as a plurality of columnar grain crystals which extend from the plurality of passages in the filter into the airfoil mold cavity.

39. A method as set forth in claim 37 wherein said step of conducting molten metal into the starter chamber includes conducting the molten metal through the airfoil mold cavity before the molten metal enters the starter chamber.

40. A method as set forth in claim 37 wherein said step of conducting molten metal into the airfoil mold cavity includes conducting the molten metal through the filter before the molten metal enters the airfoil mold cavity.

41. A method as set forth in claim 37 wherein said step of solidifying the molten metal in the airfoil mold cavity includes solidifying the molten metal in a portion of the airfoil mold cavity adjacent to the starter chamber with more than 200 columnar grains per square inch of cross sectional area in a plane extending perpendicular to a longitudinal central axis of the airfoil mold cavity.

42. A method as set forth in claim 37 wherein said step of solidifying the molten metal in the starter chamber includes solidifying the molten metal in a portion of the starter chamber disposed between the filter and the chill plate with at least ten times as many inclusions as are contained in the metal solidified in the airfoil mold cavity.

43. A method of casting a metal airfoil having a columnar grain crystallographic structure, said method comprising the steps of conducting molten metal into a starter chamber and into an airfoil mold cavity, solidifying molten metal in the starter chamber, and, thereafter, solidifying molten metal in the airfoil mold cavity, said step of solidifying molten metal in the starter chamber includes solidifying molten metal in a plurality of passages in a filter, said step of solidifying molten metal in the airfoil mold cavity includes solidifying at least a portion of the molten metal in the airfoil mold cavity as a plurality of columnar grain crystals which extend from passages in the filter into the airfoil mold cavity.

44. A method as set forth in claim 43 wherein said step of solidifying molten metal in the starter chamber includes blocking migration of contaminants from the starter chamber to the airfoil mold cavity with a filter disposed in the starter chamber.

45. A method as set forth in claim 43 wherein the starter chamber is partially defined by the mold and is partially defined by a chill plate, said step of solidifying molten metal in the starter chamber includes initiating solidification of the molten metal adjacent to the chill plate, and, thereafter, solidifying the molten metal in the passages in the filter in a direction away from the chill plate, said step of solidifying the molten metal in the airfoil mold cavity includes solidifying the molten metal in the airfoil mold cavity in a direction away from the chill plate to form a continuous body of solid metal which extends from the chill plate through the starter chamber and filter into the airfoil mold cavity.

46. A method as set forth in claim 43 wherein said step of conducting molten metal into a starter chamber and into an airfoil mold cavity includes first conducting the molten metal into the airfoil mold cavity and then conducting the molten metal into the starter chamber, said step of conducting molten metal into the starter chamber includes conducting a flow of molten metal from the airfoil mold cavity through the filter and into an end portion of the starter chamber.

47. A method as set forth in claim 43 wherein said step of conducting molten metal into a starter chamber and into an airfoil mold cavity includes first conducting the molten metal into the starter chamber and then conducting a flow of molten metal through the filter and into the airfoil mold cavity.

48. A method as set forth in claim 43 wherein said step of solidifying molten metal in a plurality of passages in a filter includes solidifying the molten metal in a plurality of linear filter passages which extend from one side of the filter to an opposite side of the filter.

49. A method as set forth in claim 43 wherein said step of solidifying molten metal in the starter chamber includes solidifying molten metal in a portion of the starter chamber disposed adjacent to a side of the filter opposite from the airfoil mold cavity, said step of solidifying molten metal in a plurality of passages in the filter being performed after solidifying molten metal in a portion of the starter chamber disposed adjacent to a side of the filter opposite from the airfoil mold cavity.

50. A method as set forth in claim 43 wherein said step of conducting molten metal into the starter chamber and into the airfoil mold cavity includes first conducting the molten metal upwardly through the filter and then conducting the molten metal upwardly to the airfoil mold cavity.

51. A method as set forth in claim 43 wherein said step of conducting molten metal into the starter chamber and into the airfoil mold cavity includes first conducting the molten metal downwardly through the airfoil mold cavity and then conducting the molten metal downwardly through the filter.

52. A method as set forth in claim 43 wherein said step of solidifying molten metal in a plurality of passages in the filter includes solidifying molten metal in passages which extend between opposite sides of the filter and are disposed in an array having more than 200 passages per square inch of surface area of the opposite sides of the filter.

53. A method as set forth in claim 43 wherein said step of solidifying molten metal in the airfoil mold cavity as a plurality of columnar grain crystals includes solidifying the molten metal in a portion of the airfoil mold cavity with more than 200 columnar grain crystals per square inch in a plane extending substantially perpendicular to longitudinal central axes of the columnar grain crystals.

54. A method of casting a single crystal metal airfoil in a mold having an airfoil mold cavity, a single crystal selector and a starter chamber, said method comprising the steps of conducting molten metal into the starter chamber, single crystal selector and airfoil mold cavity, solidifying a plurality of crystals of metal in the starter chamber, solidifying crystals of metal from the starter chamber into the single crystal selector, and, thereafter, solidifying only one crystal of metal from the single crystal selector into the airfoil mold cavity, said step of solidifying a plurality of crystals of metal in the starter chamber includes solidifying a plurality of crystals of metal in a plurality of passages in a filter, said step of solidifying crystals of metal from the starter chamber into the single crystal selector includes solidifying crystals of metal from the passages in the filter into the single crystal selector.

55. A method as set forth in claim 54 wherein said step of solidifying a plurality of crystals of metal in a plurality of passages in a filters includes solidifying crystals of metal in linear filter passages having axes which extend parallel to a longitudinal central axis of the airfoil mold cavity.

56. A method as set forth in claim 54 further including the step of blocking movement of impurities from the starter chamber into the single crystal selector with the filter.

57. A method as set forth in claim 54 wherein said step of solidifying a plurality of crystals of metal in the starter chamber includes initiating solidification of a plurality of crystals of metal adjacent to the chill plate and solidifying the crystals of metal into the passages in the filter.

58. A method as set forth in claim 54 wherein said step of conducting molten metal into the starter chamber, single crystal selector and airfoil mold cavity includes first conducting a flow of the molten metal through the airfoil mold cavity, conducting molten metal from the airfoil mold cavity through the single crystal selector, and conducting molten metal from the single crystal selector into the starter chamber.

59. A method as set forth in claim 54 wherein said step of conducting molten metal into the starter chamber, single crystal selector and airfoil mold cavity includes first conducting a flow of the molten metal into the starter chamber, conducting molten metal from the starter chamber through the single crystal selector, and conducting molten metal from the single crystal selector into the airfoil mold cavity.

60. A method as set forth in claim 54 wherein said step of conducting molten metal into the starter chamber, single crystal selector and airfoil mold cavity includes first conducting a flow of molten metal into the starter chamber, then conducting the molten metal through the filter, conducting the molten metal from the filter into the single crystal selector, and conducting the molten metal from the single crystal selector into the airfoil mold cavity.

* * * * *

UNITED STATES PATENT AND TRADEMARK OFFICE

CERTIFICATE OF CORRECTION

PATENT NO. : 5,404,930

DATED : April 11, 1995

INVENTOR(S) : Paul Stanton and Louis H. Monte

It is certified that error appears in the above-indentified patent and that said Letters Patent is hereby corrected as shown below:

Column 15, line 62, after "has" insert --a--.

Column 18, line 44, change "filters" to --filter--.

Signed and Sealed this

Seventeenth Day of October, 1995

Bruce Lehman

*Attest:*

BRUCE LEHMAN

*Attesting Officer*

*Commissioner of Patents and Trademarks*